US005938460A

United States Patent [19]

Collins et al.

[11] Patent Number: 5,938,460

[45] Date of Patent: Aug. 17, 1999

[54] VACUUM HOSE HANDLE ASSEMBLY

[75] Inventors: Gary W. Collins; Kehl T. LeSourd, both of Reno, Nev.

[73] Assignee: Thermax, Inc., Reno, Nev.

[21] Appl. No.: 09/040,296

[22] Filed: Mar. 18, 1997

[51] Int. Cl.[6] ..... H01R 4/60

[52] U.S. Cl. ..... 439/191; 15/410

[58] Field of Search ..... 15/314, 361, 410, 15/411; 439/190–195

[56] References Cited

U.S. PATENT DOCUMENTS

| | | | |
|---|---|---|---|
| 4,915,640 | 4/1990 | Hayden | 439/191 |
| 5,109,568 | 5/1992 | Rohn et al. | 15/410 |
| 5,189,755 | 3/1993 | Yonkers et al. | 15/321 |
| 5,387,117 | 2/1995 | Moyher, Jr. et al. | 439/191 |
| 5,455,984 | 10/1995 | Blase | 15/339 |

*Primary Examiner*—Khiem Nguyen
*Attorney, Agent, or Firm*—Sughrue, Mion, Zinn, Macpeak & Seas, PLLC

[57] ABSTRACT

A handle which is attachable to an electrified vacuum hose of a hydro-vacuum extraction machine, the hose including electrical wires encapsulated therein, a vacuum tube and a solution supply tube running parallel to the hose. The handle includes a handle portion secured to the vacuum tube, the handle portion having a valve chamber for receiving a valve having an actuator, a retainer for retaining the valve in the valve chamber and a cover for covering the valve chamber, wherein the solution supplying tube is attachable to the valve for supplying the cleaning solution thereto. The cover is pivotally secured to the handle portion. The handle further includes an electric plug which is retained in the handle portion and is electrically connected to the electrical wires. The handle portion includes a first half member and a second half member which are connected to each other and which define a hollow chamber therein. The plug is retained in the hollow chamber. Further, the plug includes terminals for connecting with a mating plug for supplying electricity from the electrical wires to a vacuum attachment for use in vacuuming. The retainer removably retains the valve.

13 Claims, 4 Drawing Sheets

VACUUM HOSE HANDLE ASSEMBLY

BACKGROUND OF THE INVENTION

1. Field of the Invention

The present invention relates to a handle assembly for an electrified vacuum hose which accommodates a removable water valve for use during steam cleaning and an electrical switch for providing electricity from the electrified hose to a motorized vacuum head during vacuuming.

2. Background

The present invention represents an improvement to the vacuum hose assembly of an existing vacuum extraction machine (Model Thermax AF2) manufactured by Thermax, the assignee of this application. The existing vacuum hose assembly is the subject of U.S. Pat. No. 4,316,304 entitled DOUBLE DISCONNECT, WATERPROOF ELECTRICAL CONNECTOR ASSEMBLY FOR ELECTRIFIED VACUUM HOSE FOR WET/DRY VACUUM CLEANER ("the '304 patent").

Hot water vacuum extraction machines have the dual capability of vacuuming floors and carpet and of steam cleaning (i.e., hot water extraction) the same. The steam cleaning is performed by spraying a water/detergent solution stored in a container associated with the machine onto the carpet or floor by means of a solution tube leading from the container to a spray nozzle fixed to a vacuum pick-up head.

As part of the plumbing for supplying the solution to the spray-nozzle, there is provided a removable water valve having a trigger for supplying the solution to the head upon actuation by the user. The resulting dirty solution is returned to an accumulation tank borne by the machine remote from the head and connected thereto by a suction hose leading from the tank to the vacuum head. In an effort to improve the cleaning action at the point of liquid spray application and for use during vacuuming, such vacuum heads have employed electric motors driving a rotating brush or scrubber to aid in loosening of the dirt.

In order to supply alternating current to the electric drive motor of the brush or scrubber, the '304 patent discloses an electrified vacuum hose consisting of inner and outer flexible hoses between which electrical wires are positioned for supplying electricity from one end of the hose (i.e., the supply end which attaches to the vacuum extraction machine) to the other end of the hose (the end which connects to the vacuum handle) at which an electrical plug is integrally molded to the hose. By virtue of this arrangement, when the motorized scrubber is used, the electrical cord from the scrubber is plugged into the plug on the handle. In the previous design (the '304 patent), this switch was encapsulated (molded around) by the entire handle. The new design only encapsulates the switch itself, which allows for a replaceable handle at a lower cost. It also simplifies the manufacturing process. This is accomplished by having the switch encapsulated, we no longer have to seal off the entire handle from moisture, this is crucial for safety as well as agency approvals.

As noted above, the vacuum extraction machine can be used in both a vacuum mode and an extraction or steam cleaning mode. When used in the vacuum mode, there is no need to use the spray tube or head. Thus, the water valve in the Thermax AF2 model is removably attached to the hose so that the valve and the spray head can be removed for vacuuming.

The problem associated with the present design is that there is not a conventional vacuum handle on the hose.

Instead, the user has to grasp the end of the vacuum hose at the point at which the valve is attached, which results in great inconvenience. Further, the valve is exposed thus reducing the aesthetic quality of the vacuum assembly.

SUMMARY OF THE INVENTION

To overcome these problems, the present invention is directed to an improved electrified vacuum hose which includes a unique handle which is attachable to the vacuum tube portion of a vacuum hose.

Specifically, the invention is directed to a handle which is attachable to an electrified vacuum hose of a hydro-vacuum extraction machine, the hose including electrical wires encapsulated therein, a vacuum tube and a solution supply tube running parallel to the hose. The handle comprises a handle portion secured to the vacuum tube, the handle portion including a valve chamber for receiving a valve having an actuation means, retaining means for retaining the valve in the valve chamber and a cover for covering the valve chamber, wherein the solution supplying tube is attachable to the valve for supplying the cleaning solution thereto. The cover is pivotally secured to the handle portion.

The retaining means comprises a first projection extending into the valve chamber and receivable in a retaining hole provided in the valve, the first projection being press-fit into the retaining hole.

The handle further comprises an electric plug retained in the handle portion, the electric plug being electrically connected to the electrical wires. The handle portion includes a first half member and a second half member which are connected to each other and which define a hollow chamber therein. The plug is retained in the hollow chamber. Further, the plug includes terminals for connecting with a mating plug for supplying electricity from the electrical wires to a vacuum attachment for use in vacuuming. The retaining means removably retains the valve.

DETAILED DESCRIPTION OF THE INVENTION

Figure 1:
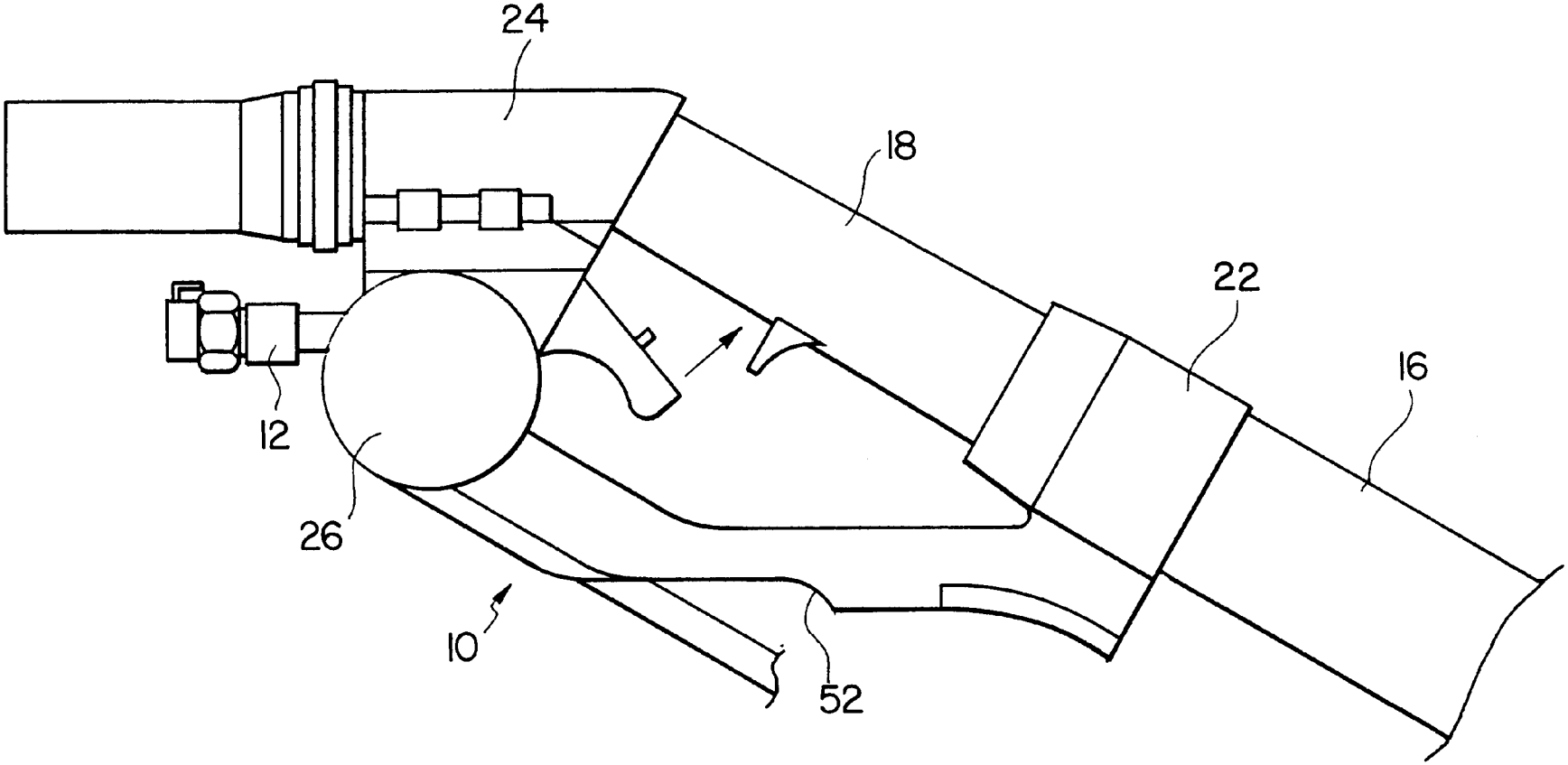
FIG. 1 is a side view of the handle assembly with the valve cover in the closed position, according to the present invention.
Figure 2:
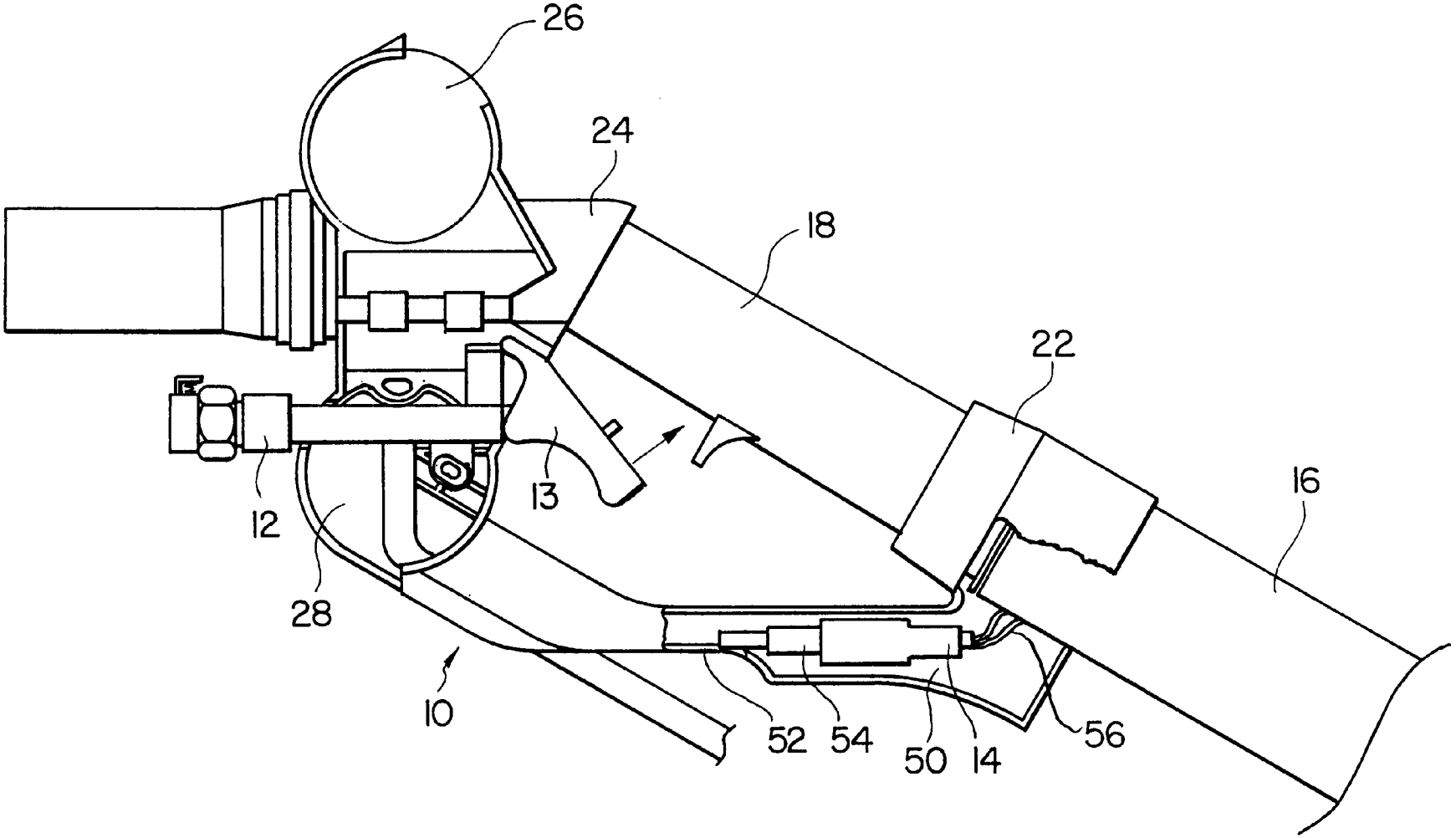
FIG. 2 is a side view of the handle assembly with the valve cover in the open position and having a cut-out portion for showing the electric plug.

Referring to FIGS. 1–4, the present invention is directed to a vacuum handle 10 for retaining an actuating valve 12, which is removably secured to the handle, and a hose plug 14, which is secured within the handle 10. As noted above, the purpose of the actuating valve 12 is to supply the solution from a solution tank (not shown) to the spray head (not shown) at the end of a vacuum tube or wand attached to a hose 16 upon actuation of a trigger 13 by the user. Also, the purpose of the plug 14 is to supply electricity from the electrified vacuum hose to the motorized brush when it is used for either vacuuming or steam cleaning.

The handle 10 is attachable to a plastic tube 18 which extends from and is attached to the vacuum hose 16. The handle includes three basic components: a right half member 20, a left half member consisting of a front portion 22 and a rear portion 24, and a pivotally attached cover 26. The left and right half members are joined together by screws or any other conventional fastening arrangement. In the illustrated embodiment, the front portion 22 and the rear portion 24 which make up the left half member are attached to the right half member using screws. The cover 26 is pivotally attached to the left half member of the handle, and specifically to the front portion 22 thereof. This portion of the handle defines a valve chamber 28 in which the valve is removably positioned and secured. After the actuator has been positioned in the space, the cover is pivoted to a closed position, shown in FIG. 1.

Figure 3:
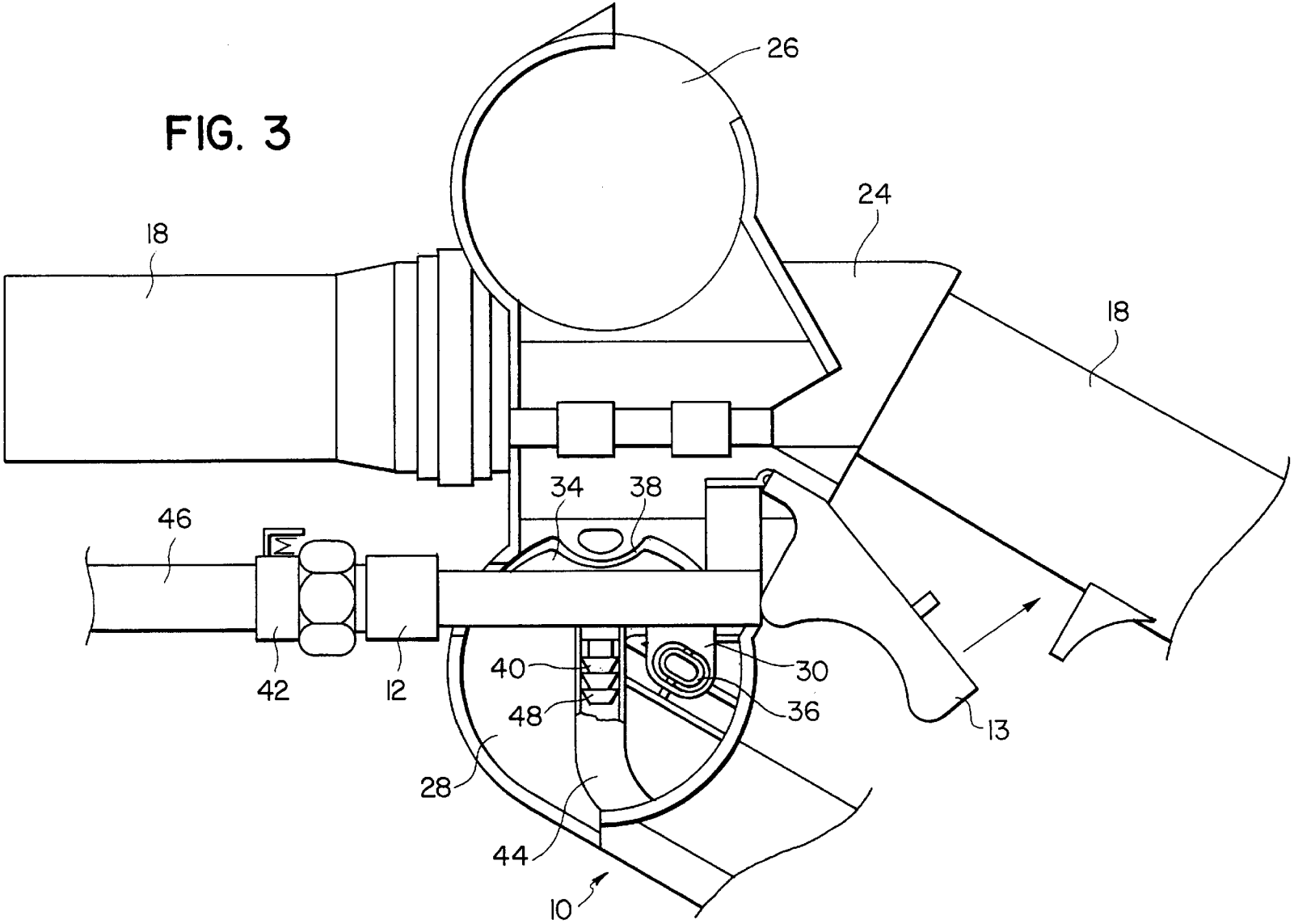
FIG. 3 is an exploded side view showing the valve chamber with the water valve therein.
Figure 4:
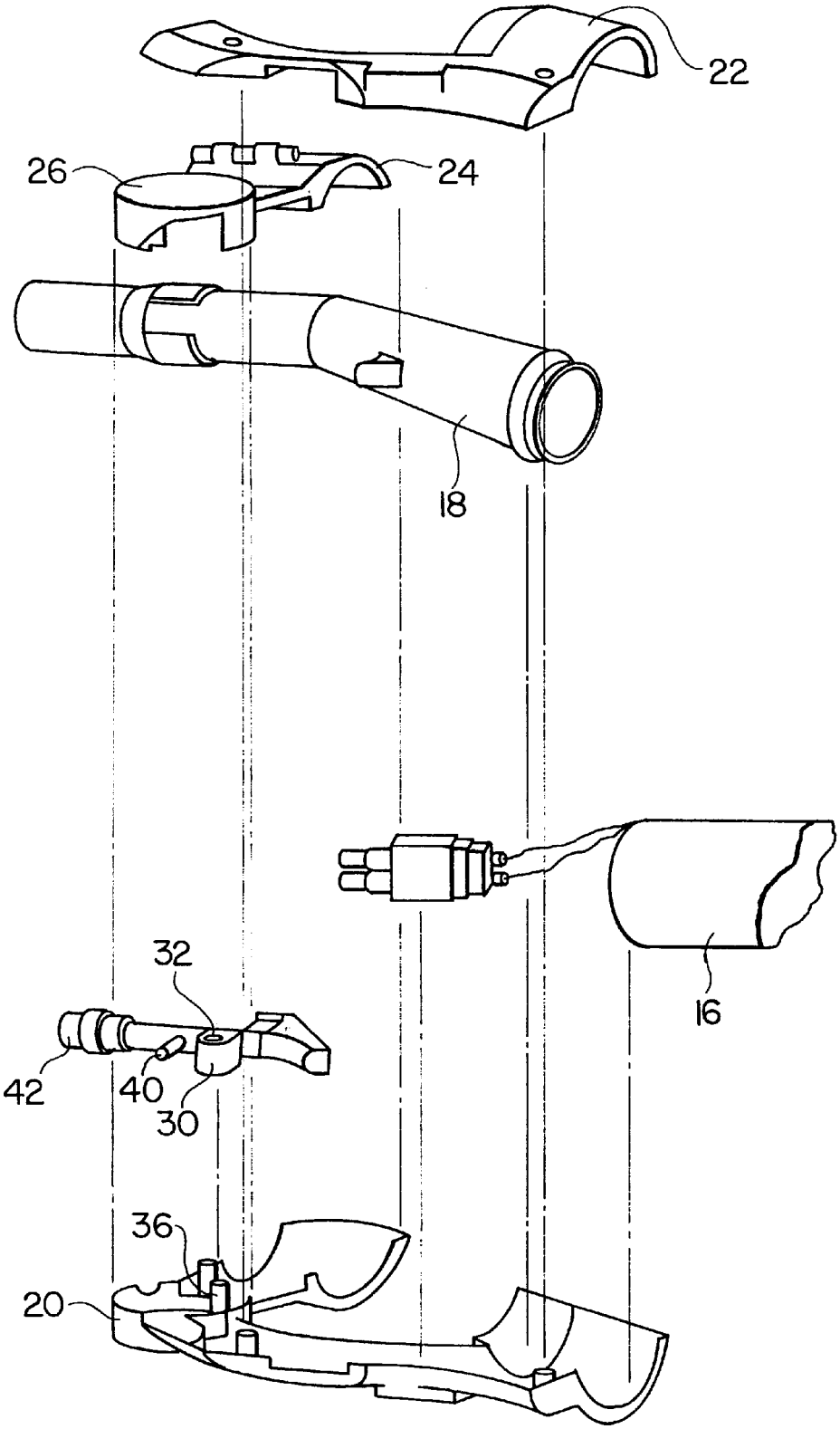
FIG. 4 is an exploded view showing the various components of the handle assembly.

Referring to FIGS. 3 and 4, the actuating valve 12 is retained in the valve chamber 28 in the following manner. The valve 12 includes a retaining member 30 projecting downwardly and having an oval hole 32 therein and a guide member 34 projecting upwardly which has an arcuate guide surface. Correspondingly, projecting from the handle and into the valve chamber 28 is a first projection 36 having an oval shape and a second projection 38 having an arcuate bottom surface. When the valve 12 is inserted into the valve chamber 28, the first projection 36 having the oval shape is received in the oval hole 32 of the retaining member 30 of the valve. Similarly, the arcuate bottom surface of the second projection 38 mates with the arcuate guide surface of the guide member 34 of the valve. There is a slight interference fit between the first projection 36 of the handle and the retaining hole 32 of the valve 12 so that the valve is retained within the chamber by friction.

As shown in FIG. 3, the valve 12 includes a solution inlet portion 40, a solution outlet portion 42 and the actuating trigger 13. A first solution tube 44 is connected at one end to the solution tank and at the opposite end to the solution inlet portion 40 of the valve. A second solution tube 46 is connected at one end to the solution outlet portion 42 and at the opposite end to the spray head (not shown). The solution inlet portion is constituted by a series of ribbed projections 48 around which the first solution tube 44 is retained. The solution outlet portion 42 is constituted by a quick-disconnect valve which is conventional. Of course, it should be understood that any other conventional arrangements could be used for attaching the tubes to the valve.

By virtue of the above arrangement, the vacuum extraction machine can easily be converted from the vacuum cleaning mode to the extraction of steam cleaning mode. In particular, in the steam cleaning mode, the valve 12 is first inserted and retained in the valve chamber 28 with the first solution tube 44 being secured to the inlet portion 40 in advance. Thereafter, the second solution tube 46 is easily attached to the quick-disconnect of the outlet portion 42 of the valve. Conversely, when the vacuum extraction machine is used in the vacuum mode, the valve can be easily removed from the handle in reverse fashion.

As noted above, another important features of the invention is that the plug 14 is not unitarily molded within the vacuum hose. Instead, the plug 30 is secured in a plug-receiving space 50 located toward the rear of the handle as defined by the left and right half members. Since it in not necessary that the plug 14 be easily removable from the handle, the plug is secured in the plug-receiving space 50 when the handle members are secured to each other with the screws.

An opening 52 is provided in the handle at the front of the plug-receiving space 50 to allow access to the plug 14 so that a mating plug 54 from the motorized brush can be engaged therewith. The hose plug 14 is completely insulated so that water cannot penetrate into the plug and cause a short or the like. Also, the wires 56 leading from the hose to the plug are completely encapsulated within the handle so that the wires are not exposed. The plug is available from Electric Cords Inc. ECI Model EP29-1P.

While the invention has been illustrated by a detailed description of a preferred embodiment thereof, it will be obvious to those skilled in the art that various changes in form and detail can be made therein without departing from the true scope of the invention. For that reason, the invention must be measured by the claims which follow and not by the foregoing preferred embodiment.

We claim:

1. A handle which is attachable to a vacuum hose assembly of a hydro-vacuum extraction machine, said vacuum hose including an electrified vacuum hose including electrical wires encapsulated therein, a vacuum tube and a solution supply tube running parallel to said electrified vacuum hose, comprising:

a handle portion secured to said vacuum tube, said handle portion including a valve chamber for receiving a valve having an actuation means, retaining means for retaining said valve in said valve chamber and a cover for covering said valve chamber, said solution supplying tube being attachable to said valve for supplying said cleaning solution thereto; and an electric plug retained in said handle portion, said electric plug being electrically connected to said electrical wires.

2. The handle of claim 1, wherein said cover is pivotally secured to said handle portion.

3. The handle of claim 1, wherein said retaining means comprises:

a first projection extending into said valve chamber and receivable in a retaining hole provided in said valve, said first projection being press-fit into said retaining hole.

4. The handle of claim 1, wherein said handle portion includes a first half member and a second half member which are connected to each other and which define a hollow chamber therein.

5. The handle of claim 4, wherein said plug is retained in said hollow chamber.

6. The handle of claim 5, wherein said plug includes terminals for connecting with a mating plug for supplying electricity from said electrical wires to a vacuum attachment for use in vacuuming.

7. The handle of claim 1, wherein said retaining means removably retains said valve such that said valve can be removed.

8. A handle which is attachable to an electrified vacuum hose assembly of a hydro-vacuum extraction machine, said hose assembly including an electrified vacuum hose including electrical wires encapsulated therein and a vacuum tube, said handle comprising:

a handle portion secured to said vacuum tube, said handle portion including a hollow chamber therein for receiving and retaining an insulated electric plug which is electrically connected to said electrical wires, wherein said handle portion further includes a valve chamber for receiving a valve, retaining means for retaining said valve in said valve chamber and a cover for covering said valve chamber, wherein a solution supplying tube is attachable to said valve for supplying said cleaning solution thereto.

9. The handle of claim 8, wherein said handle portion includes a first half member and a second half member which are connected to each other and which define said hollow chamber therein.

10. The handle of claim 8, wherein said plug includes terminals for connecting with a mating plug for supplying electricity from said electrical wires to a vacuum attachment for use in vacuuming.

11. The handle of claim 8, wherein said cover is pivotally secured to said handle portion.

12. The handle of claim 8, wherein said retaining means comprises a first projection extending into said valve chamber and receivable in a retaining hole provided in said valve, said first projection being press-fit into said retaining hole.

13. The handle of claim 8, wherein said retaining means removably retains said valve such that said valve can be removed.

* * * * *